US006581972B2

(12) United States Patent
Nojima et al.

(10) Patent No.: US 6,581,972 B2
(45) Date of Patent: Jun. 24, 2003

(54) TUBULAR LABEL, ELONGATED TUBULAR MEMBER AND METHOD OF MANUFACTURING THE SAME, AS WELL AS LABELED CONTAINER

(75) Inventors: Michihiro Nojima, Osaka (JP); Masato Nakanishi, Osaka (JP); Toshinori Mimatsu, Tokyo (JP)

(73) Assignee: Fuji Seal, Inc., Osaka (JP)

( * ) Notice: Subject to any disclaimer, the term of this patent is extended or adjusted under 35 U.S.C. 154(b) by 0 days.

(21) Appl. No.: 09/734,416

(22) Filed: Dec. 11, 2000

(65) Prior Publication Data

US 2001/0038204 A1 Nov. 8, 2001

(30) Foreign Application Priority Data

Dec. 10, 1999 (JP) ..... 11-351151
Nov. 2, 2000 (JP) ..... 2000-336075

(51) Int. Cl.[7] ..... G09F 3/00

(52) U.S. Cl. ..... 283/81; 283/72; 283/101; 283/117; 40/306; 40/308; 40/310; 40/312; 40/299; 40/324; 40/628; 215/12.1; 215/12.2; 215/365; 428/34.9

(58) Field of Search ..... 283/81, 101, 72, 283/117; 40/310, 308, 312, 306, 628, 299, 324; 215/12.1, 12.2, 365; 428/34.9

(56) References Cited

U.S. PATENT DOCUMENTS 1,212,392 A * 1/1917 Palm, Jr. ..... 40/584
3,106,032 A * 10/1963 Morgan ..... 283/111
3,632,995 A * 1/1972 Wilson ..... 235/61.11
3,650,059 A * 3/1972 Johnson ..... 40/310
3,733,002 A * 5/1973 Fujio ..... 215/12.2
3,738,524 A * 6/1973 Richie ..... 215/12 R
3,760,968 A * 9/1973 Amberg et al. ..... 40/310
3,912,100 A * 10/1975 Graham et al. ..... 215/12
3,927,484 A * 12/1975 Spiegel et al. ..... 402/310
4,018,640 A * 4/1977 Amberg ..... 428/35
4,138,026 A * 2/1979 Conklin ..... 215/12.2
4,219,124 A * 8/1980 Amberg ..... 215/12
5,056,827 A * 10/1991 Sasso ..... 283/105
5,360,628 A * 11/1994 Butland ..... 427/7
5,491,010 A * 2/1996 Eder ..... 428/35.7
5,544,770 A * 8/1996 Travisano ..... 215/230
5,604,016 A * 2/1997 Allegre ..... 283/81
5,641,084 A * 6/1997 Rice ..... 215/246
6,296,129 B1 * 10/2001 Kawasaki ..... 215/12.1
6,337,115 B1 * 1/2002 McMahon ..... 428/36.9
6,364,990 B1 * 4/2002 Grosskopf et al. ..... 156/252
2002/0166833 A1 * 11/2002 Shelby et al. ..... 215/12.1
2003/0021918 A1 * 1/2003 McKillip ..... 428/34.1

* cited by examiner

*Primary Examiner*—A. L. Wellington
*Assistant Examiner*—Mark T. Henderson
(74) *Attorney, Agent, or Firm*—Jordan and Hamburg LLP

(57) ABSTRACT

The present invention provides a tubular label with pre-printed fixed information adapted to be wrapped around a container body of a container with an inwardly facing surface of the tubular label contacting the container body and the pre-printed fixed information being visible from the outside of the container. The tubular label includes printed arbitrary information such as lottery indicia provided on the inwardly facing surface by a non-impact printer in such a manner as to be invisible through the outwardly facing surface of the tubular label. An elongated tubular member and method of manufacturing the same, as well as a labeled container are also provided.

14 Claims, 4 Drawing Sheets

TUBULAR LABEL, ELONGATED TUBULAR MEMBER AND METHOD OF MANUFACTURING THE SAME, AS WELL AS LABELED CONTAINER

BACKGROUND OF THE INVENTION

1. Field of the Invention

The present invention relates to a tubular label having an inwardly facing surface provided thereon with lottery indicia or any other arbitrary information and adapted to be wrapped around a container body, and an elongated tubular member, as well as a labeled container.

2. Discussion of the Background

A container conventionally know as that for tea, juice or any other soft drink includes a container body made of glass or plastic adapted to be filled with content such as soft drink, and a tubular label which is provided thereon with printed information such as brand, artwork and contents description and wrapped around the container body.

On the other hand, promotion campaigns for beverage or any other products are frequently held to increase sales through providing purchasers with various premiums or bonus prizes which can be awarded by purchasing the products or participating in the campaigns. Such campaigns commonly provide various campaign participation means such as a campaign application seal designed to be bonded on the surface of the label of a product, or printed campaign-related information (e.g., winning or losing symbol, or awarded points such as "1 point, 5 points, etc.) provided on the inwardly facing surface of the label on a container body of a product Of the above conventional campaign participation means, the application seal bonded on the label is likely to become a target for mischievous conduct by someone who intends to peel the seal away from the label at the store before a campaign participant purchases a product.

Conventionally, campaign-related information with different contents such as winning/losing indicia and awarded points are printed in separate printing steps, so that the labels with different contents are separately prepared. These printings are performed by known printers used for gravure printing. This separate printing manner requires separate printing units or parts such as print rolls to be prepared for the respective printing steps. In actual campaign, a less number of the winning labels are usually prepared as compared with the losing labels. Particularly for the campaigns with expensive bonus prizes, the proportion of the winning labels to the losing labels tends to be greatly reduced, or a small number of the winning labels would be enough for such campaigns. This increases the manufacturing costs of the winning labels under the conventional printing manner with the separate print rolls. It is also troublesome to properly mix the winning labels into the losing labels.

For adapting to varied campaign participation means, a different campaign participation information, lottery indicia or the like must be prepared by additional printing parts such as print rolls.

It is possible to arrange winning symbols and losing symbols on a single print roll. However, the proportion of the winning symbols to the losing symbols cannot be freely adjusted due to a limited surface area of the single print roll. This condition is also applicable to the single print roll carrying different awarded points, "1 point", "3 points", "5 points", etc.

It is therefore an object of the present invention to provide a tubular label adapted to be used as lottery, campaign application ticket, etc., that is capable of preventing mischievous conducts at the store or any other places, and providing purchasers with ease to confirm given information such as winning or losing symbols.

It is another object of the present invention to provide a tubular label adapted to be used as a lottery, campaign application ticket, etc., on which given information can instantly be printed through a printing means having a simplified construction, so that an elaborate plan can be worked out for campaigns using lotteries, campaign application tickets, etc.

SUMMARY OF THE INVENTION

In accordance with one aspect of the present invention, there is provided a tubular label with pre-printed fixed information adapted to be wrapped around a container body of a container with an inwardly facing surface of the tubular label contacting the container body and the pre-printed fixed information being visible from the outside of the container, which includes printed arbitrary information such as lottery indicia provided on the inwardly facing surface by a non-impact printer in such a manner as to be invisible through the outwardly facing surface of the tubular label.

The pre-printed fixed information includes brands, contents descriptions, commercial messages, etc., which commonly appear on labels. The printed arbitrary information includes lottery information or indicia of two or more different contents for each campaign, indicative of "win" and "lose", rewarded points such as "1 point", "5 points", etc., campaign qualification information such as ID numbers for verifying the participant's qualification to host companies or organizers of the campaigns through telephone, Internet, etc., or other types of campaign-related information.

Since the printed arbitrary information is thus provided on the inwardly facing surface of the tubular label, it is unlikely to become a target for mischievous conducts at the store or any other places, unlike the conventional campaign participation means with an application seal such as a separate tack label indicative of "win" or "lose" bonded on the label. In addition, a purchaser can easily check if he or she won or lost by simply removing the tubular label from the container of the purchased product. This is suitable for the campaign products with lottery, application tickets, or the like attached thereto.

As an additional advantage, the non-impact printer such as an inkjet printer capable of printing varying information used for printing the arbitrary information is programmable to easily and instantly print varied information contents including different representations on the labels.

According to another aspect of the present invention, there is provided an elongated tubular member adapted to be cut into individual tubular labels, which includes printed arbitrary information patterns, each being indicative of lottery indicia or the like, respectively provided at portions respectively corresponding to the individual tubular labels on the inwardly facing surface of the elongated tubular member by a non-impact printer, in which the printed arbitrary information patterns are invisible through the outwardly facing surface of the elongated tubular member.

With the elongated tubular member having the above arrangement, it is possible to successively and easily provide the individual tubular labels with two or more information contents properly arranged or ordered, enabling a simplified label application process.

According to still another aspect of the present invention, there is provide a method of manufacturing an elongated tubular member adapted to be cut into individual tubular labels, which includes feeding out a film having a first surface and a second surface, printing arbitrary information patterns at portions respectively corresponding to the individual tubular labels on the first surface of the film by a non-impact printer in such a manner as to render the arbitrary information patterns invisible through the second surface of the film, and forming the film into a tubular shape with the first surface facing inwardly by joining lateral edges of the film together.

According to another aspect of the present invention, there is provided a labeled container, which includes a transparent container body, and the tubular label described above wound around the transparent container body with an inwardly facing surface of the tubular label contacting the transparent container body. The tubular label has the inwardly facing surface provided thereon with the printed arbitrary information. The transparent container body is adapted to be filled with contents, which renders the printed arbitrary information invisible from the outside of the container.

BRIEF DESCRIPTION OF THE DRAWINGS

The above, and other objects, features and advantages of the present invention will become apparent from the detailed description thereof in conjunction with the accompanying drawings wherein.

DETAILED DESCRIPTION OF THE PREFERRED EMBODIMENT

Figure 1:
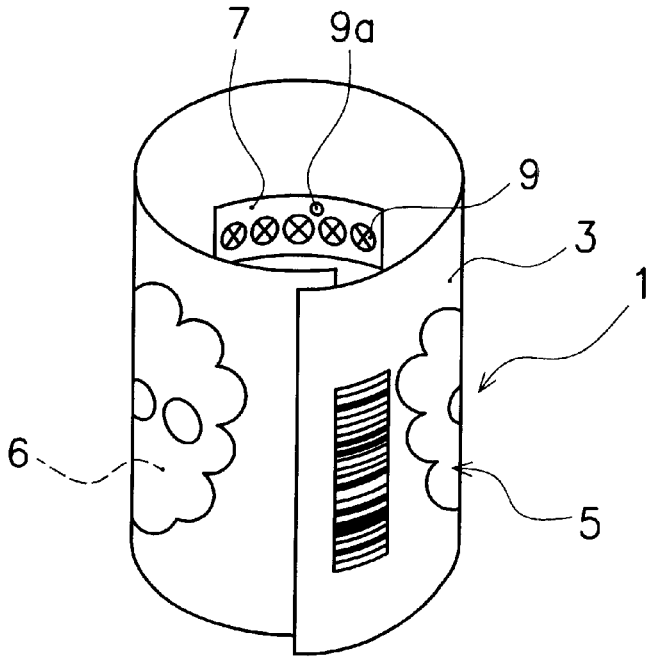
FIG. 1 is a perspective view of a tubular label according to one embodiment of the present invention.
Figure 2:
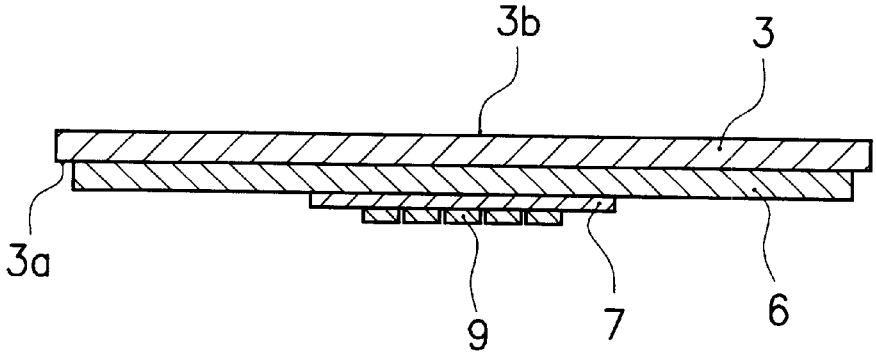
FIG. 2 is a cross section of the label of FIG. 1.
Figure 3:
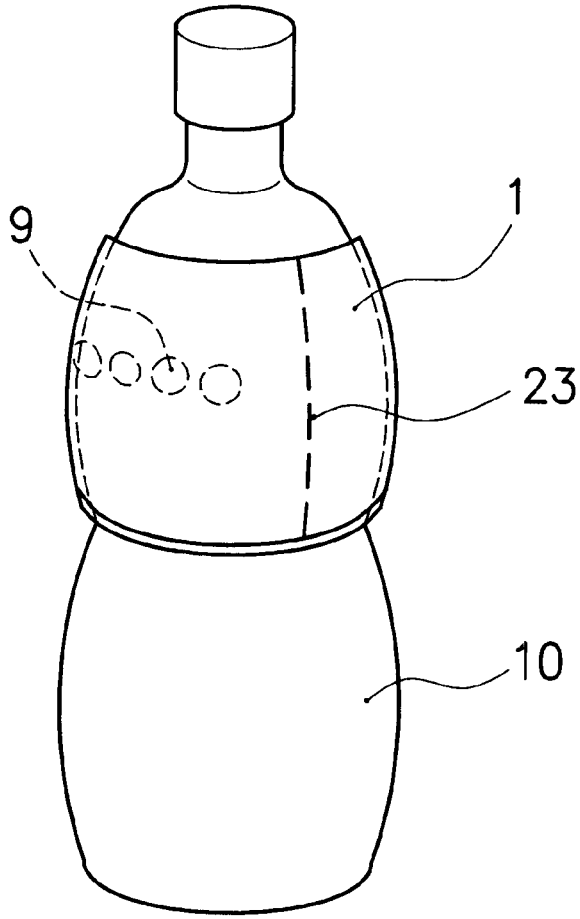
FIG. 3 is a perspective view of a container with the tubular label of FIG. 1.

One embodiment of the present invention will hereinafter be described with reference to the accompanying drawings. FIG. 1 is a perspective view of a tubular label according to one embodiment of the present invention. FIG. 2 is a cross section of the label of FIG. 1. The tubular label 1 includes a label body 5 made of a tubular film 3 having opposite lateral edges which are bonded together to form a tubular shape. The tubular label 1 is adapted to be wrapped around a container body 10, as illustrated in FIG. 3.

The film 3 is of a transparent material and has a first surface 3*a*, which is equivalent to an inwardly facing surface of the tubular label, provided with a label print layer 6 displaying fixed information such as brand, artwork, contents description and barcode. A non-adhesive label such as a heat-shrinkable label or elastically stretchable label is capable of wrapping around the container body without the use of adhesive, so that the label 1 can be easily removed from the container body 10 by simply cutting the same, rendering the container body 10 recyclable. Because of these reasons, the label of this type is extensively used for labeling the container.

Used as the film 3 for the heat-shrinkable label is a heat-shrinkable film made of polyester resin, polystyrene resin, polypropylene resin, polyvinyl chloride resin or the like with a thickness of 20 $\mu$m to 80 $\mu$m.

Used as the film 3 for the elastically stretchable label is a film made of an elastically stretchable polyethylene resin.

The surface of the label print layer 6 is entirely or partially covered with a concealing print layer 7. The concealing print layer 7 includes, for example a silver print layer and a white print layer applied on the silver print layer. Arbitrary information 9 is printed on the surface of the white print layer, rendering the arbitrary information invisible through a second surface 3*b*, which is equivalent to an outwardly facing surface of the tubular label. The concealing print layer 7 may be formed of either the white print layer or the silver print layer only. Unless the arbitrary information 9 is substantially visible through the outwardly facing surface of the tubular label, the concealing print layer 7 may be omitted.

The arbitrary information 9 includes texts, numerical characters, symbols, designs, etc., (e.g., lottery or campaign application information), which are printed by a non-impact printer of the conventional type such as an inkjet printer, laser beam printer and electrophotographic printer, of which the inkjet printer is particularly suitable for the present invention. The colors to be displayed are not necessarily limited, but a multiple color printing can be performed by the sole use of black, red, blue, green, or any other colors, or the combined use of these colors. The inkjet printer refers to a non-impact printing technique which utilizes droplets of ink, which are adapted to be shot to an object surface without contact thereto. The inkjet printer capable of printing at high speed is more preferable for the present invention.

Identification information 9*a* for identifying authentic labels and hence preventing the falsification of the labels are also printed with an invisible ink on the inwardly facing surface 3*a* of the tubular label, and more particularly either on the concealing print layer 7 or the area except the concealing print layer 7. The invisible ink refers to an ink which is usually and substantially invisible, but becomes visible under a specific light condition such as the irradiated ultraviolet rays. It is preferable to print the arbitrary information 9*a* in the same manner as described above, that is by the inkjet printer.

Now, the description will be made for a method of manufacturing the tubular label.

A continuous web of a transparent film with a larger width is drawn to be fed to a printing station where a conventional printing machine such as a web press with a relief printing plate, screen printer, photogravure printing machine or the like successively prints information patterns each being indicative of the fixed information such as brands, contents descriptions, commercial messages, etc., at such a pitch as to print them respectively at portions corresponding to individual tube members. More particularly, several rows of the information patters are printed in several rows on the film along the longitudinal axis thereof. The transparent film with printed information patterns are then rolled up. The information patterns are identical to each other, and more specifically have a common product-related information unrelated to campaign-related information or lottery indicia to be exclusively used for winning labels and losing labels. It is preferable to provide the concealing print layer during this printing process, if necessary.

The continuous web of the transparent film with a larger width is then cut along predetermined lines into several continuous strips each having a predetermined width which is equivalent to a predetermined length in the circumferential direction of the container body. In this cutting process, a slitter is used to slit the continuous web of the film, which is continuously drawn out in this slitting process. Those slit films 3 are then rolled up to have several rolls 15.

Figure 4:
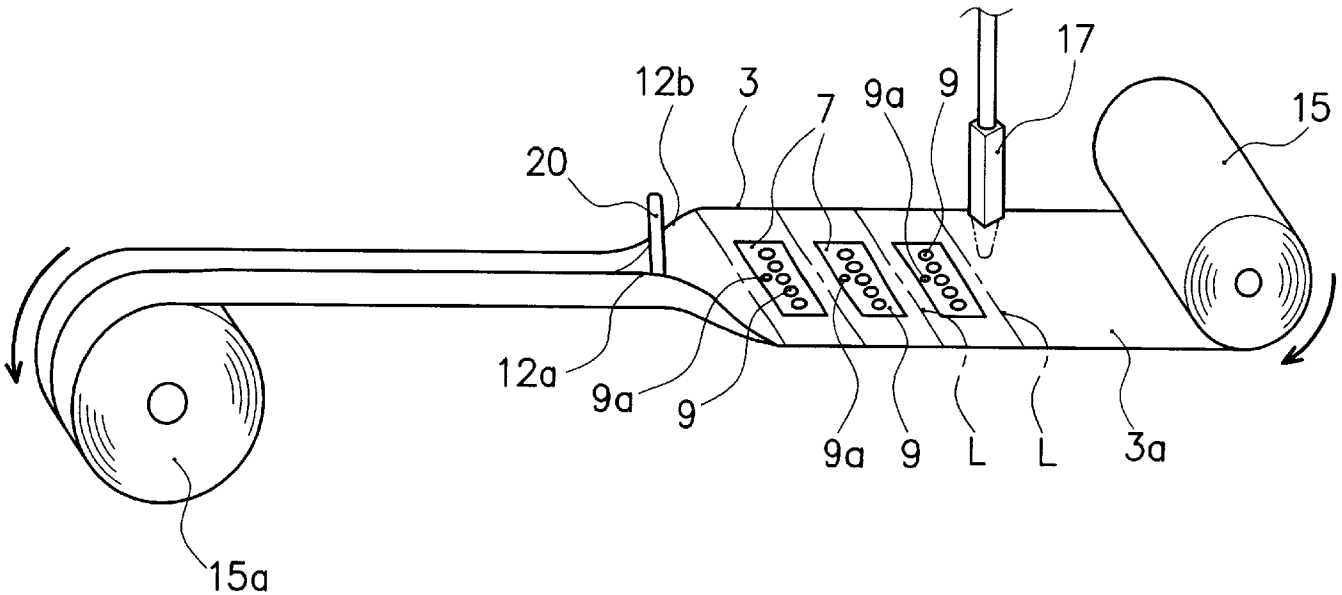
FIG. 4 is a perspective view illustrating a manufacturing process of an elongated tubular member of the present invention.

As illustrated in FIG. 4, the film 3 is then drawn from a roll 15 and conveyed to a printing station, where an inkjet printer 17 prints information patterns indicative of the arbitrary information 9 on the concealing print layer 7 provided on the label print layer 6 of the film 3 in such a manner as to correspond to the respective labels defined by cutting lines L. For example, the arbitrary information 9 is printed on the film 3 to have winning labels and losing labels in the ratio of 1 to 50. Since the inkjet printer 17 is programmable for a desirable operation, it can properly and successively print any desired information such as winning symbols or losing symbols at portions of the film 3 corresponding to the individual labels at high speed. It is also possible to vary the proportion of the winning symbols to the losing symbols or vice versa, and mixing several varieties of winning symbols into the losing symbols. Identification numbers can also be printed to identify each label. For additionally printing the identification information 9*a*, another inkjet printer (not shown) is separately arranged.

Although it is preferable to print the identification information 9*a* by the inkjet printer, a photogravure printing machine can also be employed when the same identification information 9*a* is to be printed for each label.

A nozzle 20 for discharging adhesive is disposed at the downstream side of the inkjet printer 17 to apply the adhesive on either one of the opposite lateral edges 12*a*, 12*b* of the transparent film 3 fed from the roll 15. The opposite lateral edges 12*a*, 12*b* of the film are then overlapped each other via the adhesive into a tubular shape. The film is then rolled up to have an elongated tubular member or a rolled product 15*a*. Thus, the single rolled product 15*a* provides the individual tubular labels with the several varieties of the arbitrary information 9, enabling the tubular labels to be successively wrapped around the container bodies 10 and hence the containers to be simply shipped without troublesome work to properly mix the winning labels into the losing labels.

When the tubular labels to be wrapped around the container bodies 10 are the heat-shrinkable labels, the rolled product 15*a* is set on a shrinklabeler, and fed therethrough in flat shape to a cutting station where a cutter cuts the rolled product 15 along the cutting lines L into the individual tubular labels 1. The labels 1 fed to a wrapping station then respectively have leading ends opened, through which the container bodies with or without contents therein are successively inserted. The container bodies 10 with the tubular labels 1 therearound are then conveyed to a heating station where the tubular labels 1 are heat-shrunk and tightly wrapped around the container bodies by a heat application means such as a blower for providing a stream of hot air or a steam heater, thereby manufacturing the labeled containers.

When the tubular labels 1 are the elastically stretchable labels, the labels are radially expanded to have a larger diameter, and placed around the container bodies. At this position, the force effecting the radial expansion of each label is released so that the label is tightly wrapped around the container body via the restoring force of its own. The elastically stretchable labels can thus omit the necessity of heat application.

As described above, the tubular label 1 wrapped around each container body 10 has the inwardly facing surface or the container body contacting surface provided thereon with the arbitrary information 9 and the identification information 9*a* printed on the concealing print layer 7, so that the arbitrary information 9 and the identification information 9*a* cannot be visually observed from the outside of the label 1 or through the film and the concealing print layer. When the container body 10 is a transparent bottle, the content such as liquid with deep color or color similar to the content is preferably filled in the transparent bottle. Whereby, the arbitrary information 9 on the inwardly facing surface of the label cannot visually be observed, even if the attempt has been made to view it through a transparent portion of the bottle and/or the label. If a portion of the label or the transparent bottle reflects an appearance of the arbitrary information through the content, a tack label or the like is preferably attached thereon to omit the possibility to trigger mischievous conducts of a person who tries to see the arbitrary information through such a portion, or omit the possibility of causing any other problems. In this case, it is a matter of course that the arbitrary information 9 is constantly and substantially invisible through the content with deep color or color similar to the content, even if the tack label or the like is not provided on the transparent bottle or the label.

The arbitrary information on the inwardly facing surface of the tubular label 1 can visually be observed after the tubular label is cut or pulled away from the container body 10, or the bottle is emptied by consuming or drinking the content. This manner for visual observation enables the purchaser to easily check the arbitrary information indicative of "win" or "lose", or the like. For the campaign providing a qualification system that requires campaign participants to collect awarded points such as "1 point", "2 points", . . . or "5 points" printed on each label to gain a predetermined number of points by purchasing one or more products, there is provided ease of the visual observation, so that the selection as to which campaign participation means should be employed can be easily conducted.

As described above, the tubular label 1 is also provided with the identification information 9*a* printed in invisible ink, so that the collected labels 1 sent from the campaign participants to the host company or organizer of the campaign can be checked to see if they are authentic or not by finding particular indicia, letters or the like emerging on the surfaces of the labels through the irradiation of the ultraviolet rays or any other specific lights. Thus, any acts to illicitly participate in the campaign or obtain a bonus prize can be prevented.

In the above embodiments, while the description is made for the container body in the form of a cylindrical bottle, it may be of a varying shape such as a square bottle. Also, a material of the container body is not necessarily limited to a specific one. As examples of the material of the container body, it can be cited a plastic bottle or PET (polyethylene terephthalate) bottle, glass bottle, metal bottle, plastic cup and paper cup.

It is also possible to provide the tubular label 1 with a perforated line 23 formed throughout the entire length of the label for ease of the label rupturing, as illustrated in FIG. 3.

Figure 5:
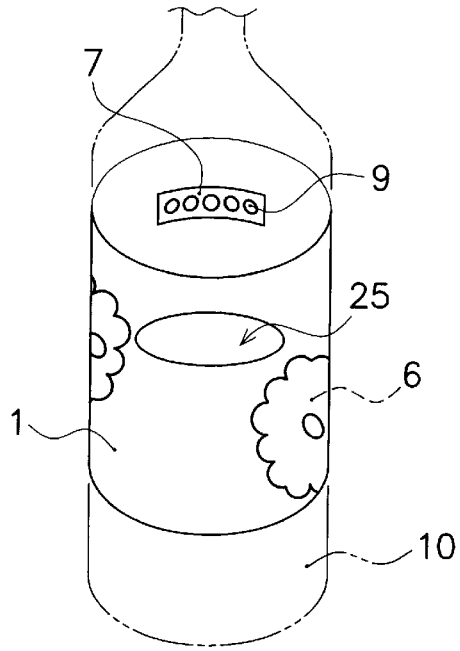
FIG. 5 is a perspective view of the tubular label according to another embodiment of the present invention.
Figure 6:
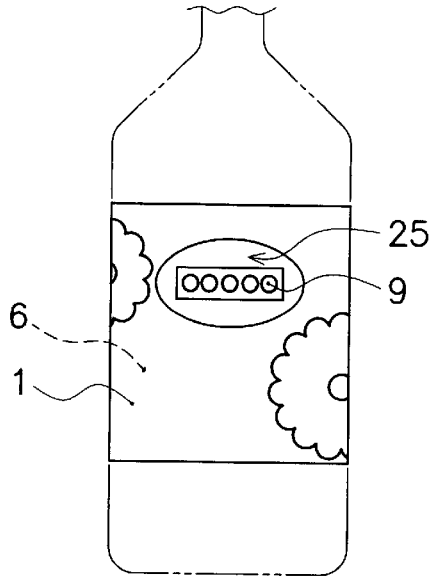
FIG. 6 is a front view of the label of FIG. 5.

As illustrated in FIGS. 5 and 6, a transparent window portion 25 may be provided on the opposite side of the tubular label, through which the arbitrary information 9 can visually be observed. Since the label print layer 6 is provided on the area of the label except the transparent window portion 25, the arbitrary information 9 cannot visually be observed through the area with the label print layer 6. In actual application, the transparent container body 10 is filled with a dark colored liquid or any other contents, under which condition the arbitrary information cannot visually be observed. Therefore, to achieve the visual observation, the content in the container body 10 must be drunken or consumed to lower the surface of the content to at least the height of the window portion 25 or so, through which the arbitrary information 9 at the opposite side of the tubular label can be observed.

It also enables the inkjet printer to print production lot numbers or any information other than the campaign-related information.

According to the present invention as embodied, the following desirable effects are obtainable:

Firstly, unlike the conventional campaign participation means using a campaign application seal or the like made of a tack label attached on the label of the container body, mischievous conducts at the store or any other places can effectively be prevented. In addition, the purchaser can easily check the arbitrary information 9 such as the lottery indicia of the purchased product. This renders the present invention suitable for the campaign participation means using lottery or campaign application forms designed to be attached on products.

Secondly, since the arbitrary information is printed by using the inkjet printer or any other types of the non-impact printers, the contents of printed arbitrary information are easily and instantly changeable without deteriorating the successive printing of the arbitrary information on the continuously fed film. Whereby, various information can properly be arranged at predetermined locations on the film with sufficiently following the feeding speed of the film. Accordingly, it is possible to omit the necessity of preparing a printing plate to be mounted on a printing roll for each content of the arbitrary information unlike the conventional printing method. This enables the labels to be manufactured at low cost and different arbitrary information patterns to be easily and instantly printed on the labels. In addition, the non-impact printer which prints the arbitrary information is programmable to print various characters, letters, designs and the like, so that the contents of the arbitrary information are easily changeable. Thus, the printing method using the non-impact printer can simultaneously cope with several campaigns which are carried out with short cycle times.

Thirdly, when the tubular film is provided on the inwardly facing surface with the identification information printed in invisible ink, in addition to the arbitrary information such as lottery indicia, it is possible to check to see if the tubular labels are authentic or not, and hence prevent the falsification of the labels.

This specification is by no means intended to restrict the present invention to the preferred embodiments set forth therein. Various modifications to the tubular label, the elongated tubular member and the method of manufacturing the same, as well as the labeled container of the present invention, as described herein, may be made by those skilled in the art without departing from the spirit and scope of the present invention as defined in the appended claims.

What is claimed is:

1. An elongated tubular member for being cut into individual tubular labels, said individual tubular labels for being respectively wrapped around containers, comprising:

an elongated tubular film formed from one of a heat-shrinkable film and an elastically stretchable film;

a label print layer provided on said elongated tubular film;

a concealing print layer provided on said label print layer;

said concealing print layer including at least one of silver print layer and a white print layer;

arbitrary information patterns being respectively printed at portions respectively corresponding to individual tubular labels on a first surface of the concealing print layer by a non-impact printer that varies an arbitrary information pattern of said arbitrary information, so that said arbitrary information patterns are positioned on said elongated tubular member, in which said first surface of said concealing print layer is an inwardly facing surface of each of said individual tubular labels with respect to a corresponding container when said individual labels are respectively wrapped around containers;

said arbitrary information patterns respectively corresponding to each individual tubular label being different for each of said individual tubular labels; and said elongated tubular film having an opacity so that when said individual tubular labels are respectively wrapped around said containers, each of said arbitrary information patterns is completely invisible through an outwardly facing surface of each of said individual tubular labels, whereby the tubular film is free from emboss like deformations as a result of the non-impact printing.

2. An elongated tubular member according to claim 1, wherein the arbitrary information patterns identify lottery information.

3. An elongated tubular member according to claim 1, wherein said arbitrary information patterns are random irregular patterns.

4. An elongated tubular member according to claim 1, wherein said arbitrary information patterns include at least one of a winning symbol and a losing symbol for respective individual tubular labels.

5. An elongated tubular member according to claim 1, wherein said arbitrary information patterns include awarded points.

6. An elongated tubular member according to claim 1, wherein said arbitrary information patterns include ID numbers.

7. An elongated tubular member according to claim 1, wherein authentic identification information is provided with invisible ink in the arbitrary information patterns for preventing falsification of said individual tubular labels.

8. An elongated tubular member according to claim 1, wherein arbitrary information patterns are positioned on said elongated tubular member in irregular patterns across an entire length of the elongated tubular member.

9. An elongated tubular member according to claim 6, wherein said ID numbers are campaign qualification information.

10. An elongated tubular member according to claim 6, wherein said ID numbers are different for each of said individual tubular labels.

11. An elongated tubular member according to claim 7, wherein said authentic identification information is provided for each respective individual tubular label of said individual tubular labels.

12. An elongated tubular member for being cut into individual tubular labels, said individual tubular labels for being respectively wrapped around containers, comprising:

an elongated tubular film formed from one of a heat-shrinkable film and an elastically stretchable film;

a label print layer provided on said elongated tubular film;

a concealing print layer provided on said label print layer;

said concealing print layer including at least one of silver print layer and a white print layer;

arbitrary information patterns being respectively printed at portions respectively corresponding to individual tubular labels on a first surface of the concealing print layer by a non-impact printer that varies an arbitrary information pattern of said arbitrary information, so that said arbitrary information patterns are positioned on said elongated tubular member, in which said first surface of said concealing print layer is an inwardly facing surface of each of said individual tubular labels with respect to a corresponding container when said individual labels are respectively wrapped around containers;

said arbitrary information patterns respectively corresponding to each individual tubular label identifying at least two different lottery symbols that are positioned on said elongated tubular member so as to be mixed with each other in irregular patterns; and said elongated tubular film having an opacity so that when said individual tubular labels are respectively wrapped around said containers, each of said arbitrary information patterns is completely invisible through an outwardly facing surface of each of said individual tubular labels, whereby the tubular film is free from emboss like deformations as a result of the non-impact printing.

13. An elongated tubular member according to claim 12, wherein said arbitrary information patterns include at least one of a winning symbol and a losing symbol for respective individual tubular labels.

14. An elongated tubular member for being cut into individual tubular labels, said individual tubular labels for being respectively wrapped around containers, comprising:

an elongated tubular film formed from one of a heat-shrinkable film and an elastically stretchable film;

a label print layer provided on said elongated tubular film;

a concealing print layer provided on said label print layer;

said concealing print layer including at least one of a silver print layer and a white print layer;

arbitrary information patterns being respectively printed at portions respectively corresponding to individual tubular labels on a first surface of the concealing print layer by a non-impact printer that varies an arbitrary information pattern of said arbitrary information, so that said arbitrary information patterns are positioned on said elongated tubular member, in which said first surface of said concealing print layer is an inwardly facing surface of each of said individual tubular labels with respect to a corresponding container when said individual labels are respectively wrapped around containers;

said arbitrary information patterns respectively correspond to each individual tubular label being one of at least two different awarded points that are positioned on said elongated tubular member so as to be mixed with each other in irregular patterns; and said elongated tubular film having an opacity so that when said individual tubular labels are respectively wrapped around said containers, each of said arbitrary information patterns is completely invisible through an outwardly facing surface of each of said individual tubular labels, whereby the tubular film is free from emboss like deformations as a result of the non-impact printing.

* * * * *